US006896250B2

(12) United States Patent
Hillebrand

(10) Patent No.: US 6,896,250 B2
(45) Date of Patent: May 24, 2005

(54) PRINTED PRODUCT AND METHOD FOR PRODUCING A PRINTED PRODUCT

(75) Inventor: Bernd Anton Hillebrand, Bergrheinfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 146 days.

(21) Appl. No.: 10/229,164

(22) Filed: Aug. 28, 2002

(65) Prior Publication Data

US 2002/0195813 A1 Dec. 26, 2002

Related U.S. Application Data

(62) Division of application No. 09/581,163, filed as application No. PCT/DE98/03697 on Dec. 16, 1998, now abandoned.

(30) Foreign Application Priority Data

Dec. 16, 1997 (DE) ..... 197 55 691

(51) Int. Cl.[7] ..... B41F 13/68
(52) U.S. Cl. ..... 270/52.09; 270/5.02; 270/21.1
(58) Field of Search ..... 270/52.07, 52.08, 270/52.09, 1.01, 5.01, 20.1, 32, 41, 43, 52.17, 21.1, 5.02

(56) References Cited

U.S. PATENT DOCUMENTS

| | | | | | |
|---|---|---|---|---|---|
| 3,275,316 | A | * | 9/1966 | Cleary, Jr. | 270/52.24 |
| 4,538,833 | A | * | 9/1985 | Trikilis | 281/2 |
| 4,901,993 | A | * | 2/1990 | Hansch | 270/21.1 |
| 4,989,850 | A | * | 2/1991 | Weller | 270/1.02 |
| 4,997,205 | A | * | 3/1991 | Hansch | 281/2 |
| 5,230,501 | A | * | 7/1993 | Melton | 270/41 |

FOREIGN PATENT DOCUMENTS

| | | |
|---|---|---|
| FR | 2 614 234 | 10/1988 |
| GB | 2 299 970 | 10/1996 |

OTHER PUBLICATIONS

Walenski, Von Wolfgang, Perforieren Sie als Offsetdrucker etwa immer noch im Buchdruck?, pp. 45–46, Polygraph Treffpunkt druckindustrie, Sep. 1996.
Goss Community, Jul. 1, 1977.

* cited by examiner

*Primary Examiner*—Patrick Mackey
(74) *Attorney, Agent, or Firm*—Jones Tullar & Cooper PC

(57) ABSTRACT

A printed product is produced on a web-fed rotary newspaper printing press. The dimensions of the resultant printed product can be varied. Paper webs of constant and preselected widths are combined with sub-paper webs of preselected and somewhat smaller widths. These webs are combined and are brought together.

15 Claims, 5 Drawing Sheets

PRINTED PRODUCT AND METHOD FOR PRODUCING A PRINTED PRODUCT

CROSS-REFERENCE TO RELATED APPLICATIONS

The subject U.S. patent application is a division of U.S. application Ser. No. 09/581,163, filed Jun. 13, 2000 and now abandoned. U.S. application Ser. No. 09/581,163 was the U.S. National Phase of PCT/DE98/03697, filed Dec. 16, 1998, published as WO 99/30910 on Jun. 24, 1999 and claiming priority to DE 197 55 691,4 filed Dec. 16, 1997.

FIELD OF THE INVENTION

The present invention is directed to a method for producing a printed product. The printed product includes material webs and partial width material webs.

DESCRIPTION OF THE PRIOR ART

U.S. Pat. No. 4,901,993 A describes a method for producing a printed product which is easy to open. Here, material webs of different widths are conducted on top of each other and are subsequently transversely folded, so that a double page lying on the inside projects past a first page of the printed product.

GB 2 299 970 A discloses a folded printed product, whose double pages have a format of the same size, but are folded asymmetrically.

SUMMARY OF THE INVENTION

The object of the present invention is directed to a method for producing a printed product.

The invention has the following advantages in particular:

A continuously changeable total surface can be produced by the use of a newspaper rotary printing press without changing the exterior formats of the product, for example a tabloid product of the sizes 420×289 mm.

Newspaper rotary printing presses known so far have the disadvantage that they can only produce fixed page skips, or jumps and therefore can produce newspapers having total surfaces which can only be changed in steps. If, for example, a single width newspaper rotation with double cylinder circumference—a so-called eight page rotation, is assumed, it is possible by the use of this to produce page skips of two pages for broadsheets, four pages for tabloids, or eight pages for magazines of half the tabloid format in double production.

In a more economical type of production, "collection production", the producible printed surfaces, or respectively page skips, known in the past, are even more disadvantageous. It is only possible to produce skips or jumps of four pages for broadsheets, eight pages for tabloids or only sixteen pages for magazines.

The result of this is that the print shops are always forced, also editorially, to process the information for their newspaper and newspaper-like products in such a way that the page skips which can be produced are filled on the entire page. This necessity becomes more difficult, the larger the percentile change of the entire surface caused by the page skips becomes. For example, with a rotation of double the circumference, the change for a 16-page tabloid product is 25% in double production and in collection production even 50%. These large page skips can often not be sensibly produced editorially, even with the most modern software systems—such as an automatic letter size adaptation, for example, which "compresses" a defined amount of information into a defined number of pages. In these cases, it is very often necessary to do completely without an investment in the more economical rotations with double cylinder circumferences, or that these must be at least operated in double production.

A further economical disadvantage of these whole page printed surface skips are the paper costs which, in connection with a newspaper or newspaper-like product, makes a significant difference at approximately 30%.

If, for example, the editing staff perceives the possibility, or even the necessity, to include an additional whole-page advertisement in the product, it is necessary to create additional "filler pages" for producing this whole page advertisement. This means that higher paper costs than would actually be necessary must be accepted. The situation is even more serious in the situation of free newspapers, which specialize primarily in small private ads and which scarcely have editorial "filler pages".

The present invention consists in that, for example in a double-width rotation for the production of newspapers or newspaper-like products, it is possible to use, besides a paper web of full, half and quarter width, simultaneously also a web having any arbitrary variable width. Because of this, it is possible to variably change the total surface of the product continuously, without the original dimensions of the product being changed, such as, for example, in case of a general web width change of all webs.

In this connection, it has been shown to be technically advantageous to operate with variable web widths between one half and a full web width in case of single-width rotations, and in case of double-width rotations, with variable web widths between a quarter and half a web width. The reason for this is that very narrow web widths, narrower than a broadsheet page, are very difficult to handle by machine technology, and that too large a number of different web widths is uneconomical to procure. For example, in a double-width rotation it is possible to achieve the same effect with a ⅜-width and a normally present ½-width web as with a ⅞-width web, as seen in FIGS. 1 and 2.

The additional web strip of arbitrary width can be employed for all products which can be produced in the newspaper rotation, such as broadsheet products, tabloid products, magazine products, etc., for example, and can be processed with web guide elements customary in newspaper rotation, such as turning bars, mixing arrangements, funnel groups, etc., and with their help can be placed at almost any location in the product. It is moreover possible to attach these width-variable web strips, which are processed into lateral strips of partial width, to the whole product by the use of all known attachment aid devices, for example stapling or gluing devices, etc. In the same way, it is possible to use and to process several webs of variable web width simultaneously.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Some printed products in accordance with the present invention, and in a broadsheet format are represented by way of example in FIG. 5 to FIG. 12.

Figure 1:
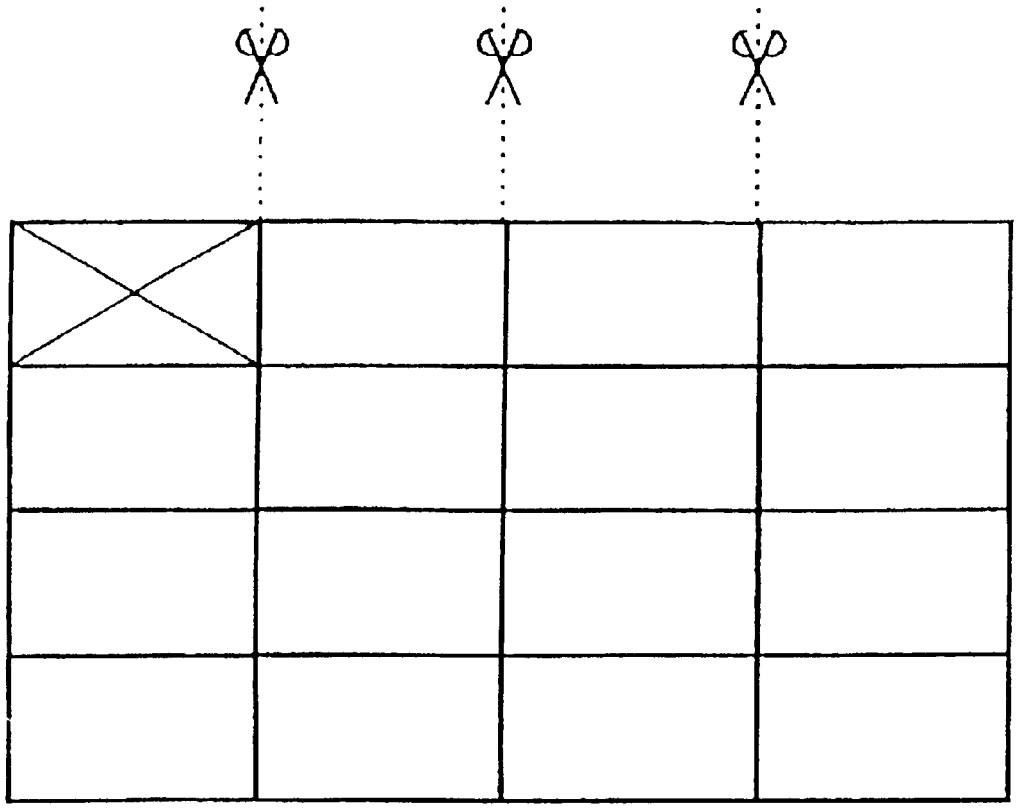
FIG. 1, a schematic representation of a material web of a width of four broadsheet pages, FIG. 2, a schematic representation of a material web of variable width, FIG. 3, a schematic representation of a material web in broadsheet format, FIG. 4, a schematic representation of a material web in tabloid format, FIGS. 5 to 16, schematic representations of printed products.
Figure 2:
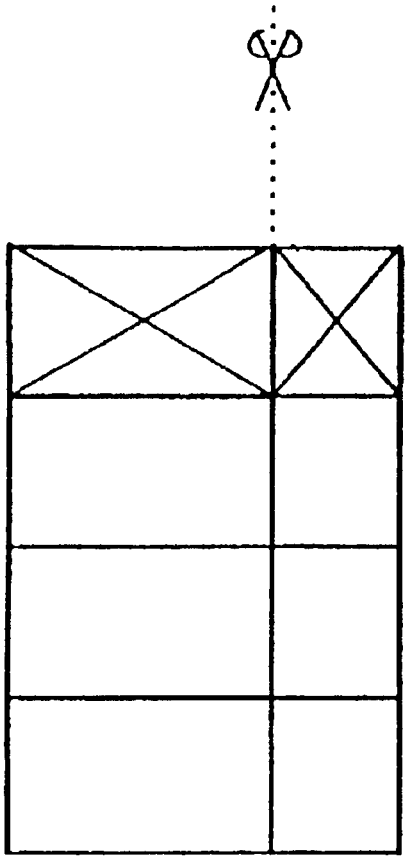
Figure 3:
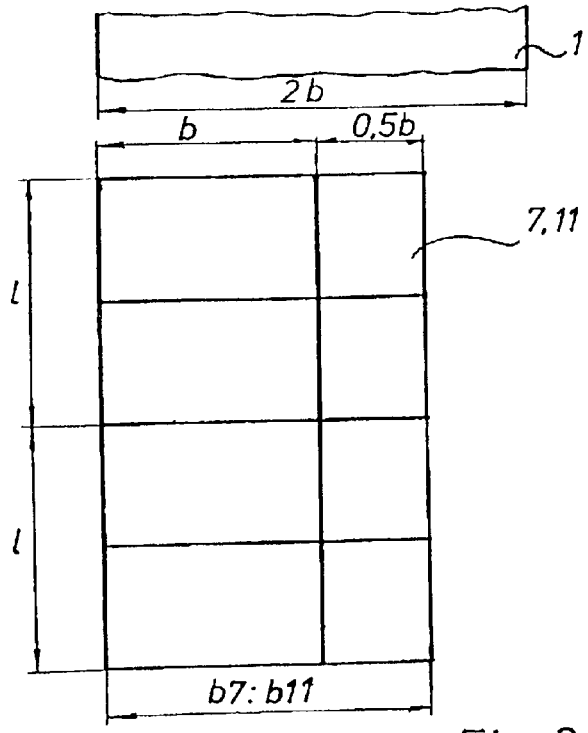
Figure 4:
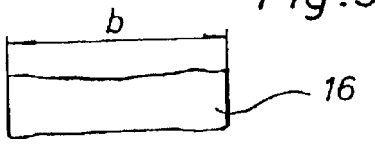
Figure 4:
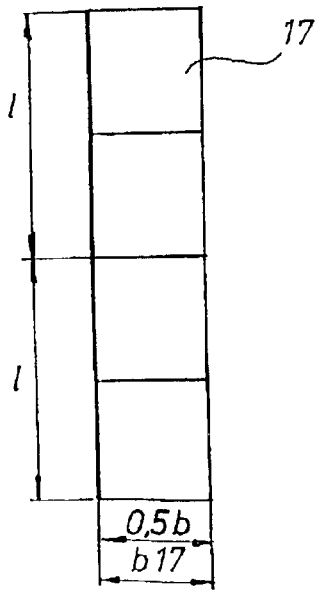

A first material web 1 can be a "single width" material web 1, or a partial material web 1 of a multiple-width, for example a double-width, longitudinally cut material web 1. In what follows, the designation material web 1, as seen in FIG. 1, is used for a first material web 1, also for simplification in case it is a cut partial material web.

Figure 5:
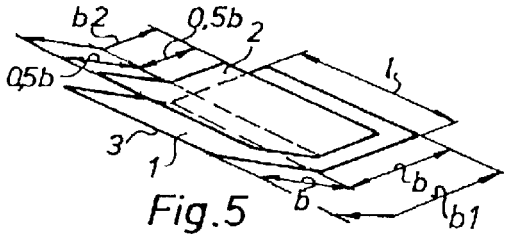

To produce a printed product of a first preferred embodiment as seen in FIG. 5, a first material web 1 of a first width b1, for example b1=2b, and a first partial material web 2 of a width b2, are brought together.

For example, the width b2 of the partial material web 2 equals the width b and thus corresponds to half the width b1 of the first material web 1. The material web 1 and the partial material web 2 are conducted on top of each other in such a way that their outer edges extend parallel and symmetrically in respect to each other, all as seen in FIG. 5.

For example, the material web 1 and the partial material web 2 are longitudinally folded by the use of a funnel, not represented, and are subsequently laterally cut at a length 1, which length 1 is equal to a section length. Thus, the printed product has a first page 3, located on the outside and, of a format width b times length 1.

A double page formed by the partial material web 2, whose individual pages have half the width of the first page 3, is located inside a first double page constituted by the material web 1.

Figure 6:
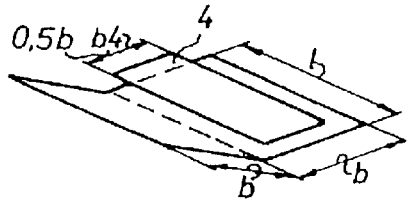
Figure 7:
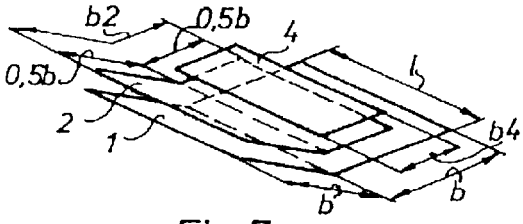
Figure 8:
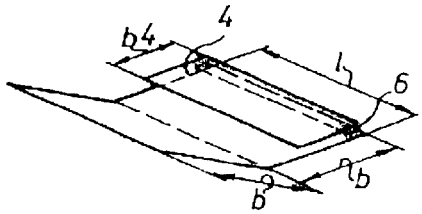
Figure 10:
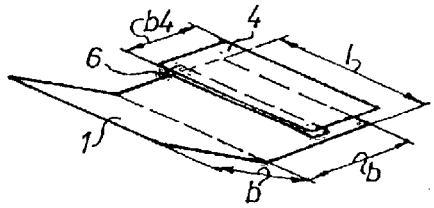

In further preferred embodiments depicted in FIGS. 6, 7, 8, 10, a second partial material web 4 of a width b4, for example b4=0.5 b, is brought to the first material web 1. This partial material web 4 can be brought in, for example, congruently with an outer edge of the first material web 1, as seen in FIGS. 8, 10, or with a provided fold line of the material web 1 as seen in FIGS. 6, 7, and can be fastened, for example by the use of an adhesive strip 6, on the first material web 1, as seen in FIGS. 8, 10, or can be loosely inserted, as seen in FIGS. 6, 7.

This second partial material web 4 can be brought in additionally as seen in FIG. 7 to the material web 1 and to the first partial material web 2 of the first preferred embodiment depicted in FIG. 5.

Figure 9:
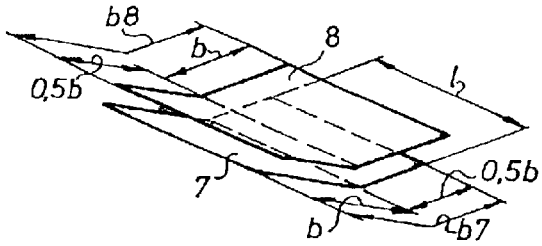

FIG. 9 shows a preferred embodiment in which two partial material webs 7, 8 respectively have widths b7, b8, for example b7, b8=1.5 b. The two partial material webs 7, 8 are offset with respect to each other by b/2 in the direction of the web width, so that a longitudinal fold folds the partial material webs 7, 8 asymmetrically.

Figure 11:
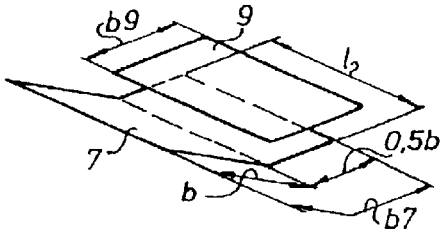

In FIG. 11, a partial material web 9 of a width b9, for example b9=b, has been inserted into the partial material web 7, so that a left outer edge of the partial material web 9 lies congruently on the fold line of the partial material web 7 and rests on the shorter leg of the partial material web 7.

Figure 12:
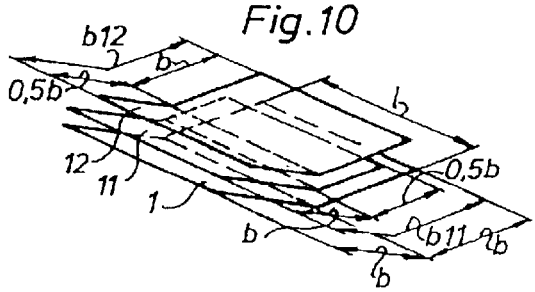

FIG. 12 shows a printed product in which two partial material webs 11, 12, respectively of a width b11, b12=1.5 b, have been placed on the first material web 1 of a width 2*b*, so that a left outer edge of the partial material web 11 is approximately congruent with the left outer edge of the material web 1, and a right outer edge of the partial material web 12 is approximately congruent with the right outer edge of the material web 1.

Printed products in tabloid format are represented, by way of example, in FIGS. 13 to 16.

Figure 13:
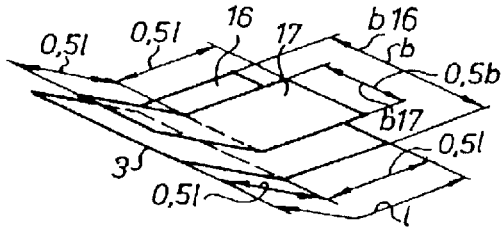
Figure 14:
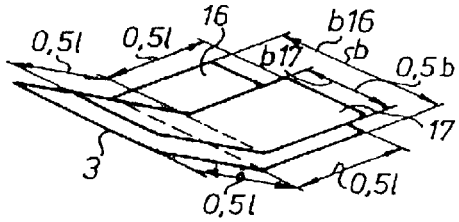
Figure 15:
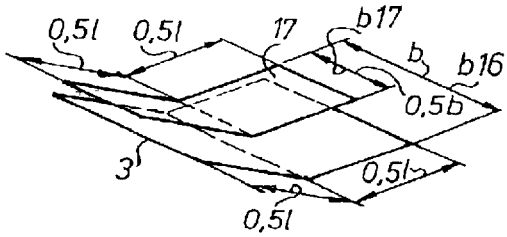
Figure 16:
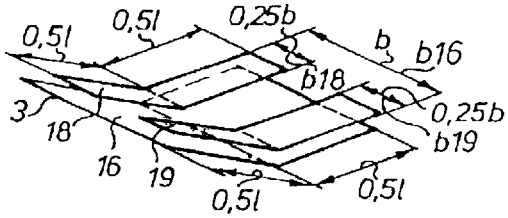

To make the printed products in FIGS. 13, 14, 15, a material web 16 of a width b16, for example b16=b, and a partial material web 17 of a width b17, for example b17=0.5 b, are brought on top of each other. Subsequently, the material web 16 and the partial material web 17, placed on top of each other, are transversely cut into signatures, and are transversely folded, for example by the use of a folding jaw cylinder. As represented in FIG. 16, it is also possible to insert several partial material webs 18, 19 of a width b18, b19, for example b18, b19=0.25 b, next to each other and/or on top of each other, into the material web 16.

It is common to all of the preferred embodiments, that a maximum format is set by the first, outside located page or title page of a double width page of a signature, and that at least one page of a smaller format than the first page lies inside this folded signature.

Since all printed products are made of brought-together or assembled material webs, at least one outer edge of the narrow material web lies neither on an outside edge nor on a fold line of the wide material web.

Measurement and ratio information, as well as the terms "equal to" and "congruent" should be understood in the technical sense, so that tolerances are permissible. These tolerance can appear in the millimeter range, in particular with folded products.

It is possible, with the present printed products, to selectively surround a block of information which is connected by its contents, for example an advertisement, a group of advertisements, a group of advertisements in the form of a column, or entire, or respectively parts of columns, with longitudinal perforations and with transverse perforations, and to cut them out of the printed product in this way.

The multifunctional perforation can be achieved by the use of machine technology in the following manner:

Assume that the newspaper product is configured in the form of a broadsheet product in columns, as seen in FIG. 1 and all pages are produced with the same column width. The longitudinal perforation device can be arranged at a location at which several, or even all, of the webs or strands of webs are combined. Because of this, one longitudinal perforation device with several perforation cutters, which can be of variable width transversely to the paper web, is sufficient.

If, however, individual pages are to be differently longitudinally perforated, these pages, or respectively the associated paper web, must be equipped with a separate longitudinal perforation device.

The transverse displacement of the individual longitudinal perforation cutters can be performed manually or automated, and in the extreme case can be performed by remote control.

In the simplest case, the transverse perforation can be uniform for all pages of the product. In this case, only one transverse perforation device is required. If all pages only have a single transverse perforation, one transverse perforation cutter is sufficient.

If several transverse perforations are required, the transverse perforation device must be equipped with several transverse perforation cutters. Ideally, the transverse perforation cutters are arranged in such a way that they can be varied in number, as well as in the circumferential position, and therefore also in the distances between the perforation lines.

In the extreme case, each page has several transverse perforation lines which are different from page to page, and which can extend over the entire page width or over a partial width of the page, for example a longitudinally perforated column. In this case, it is necessary that each paper web be equipped with a transverse perforation device, which contains respectively one transverse perforation cutter per the required number of transverse perforations over the width of the paper web, and per required number of transverse perforations, over a length of the paper web corresponding to a cylinder circumference or half a cylinder circumference.

The cutter holder must be configured such that the respective cutter position can be varied in the transverse and in the circumferential directions, that different perforation cutters of different widths can be used, and that the number of cutters and their circumferential positions, with respect to each other, can be varied.

In this case, the use of an electronically controlled independent drive mechanism for this perforation device makes the synchronization of perforation and rotation and of an exactly register-maintaining perforation easier.

If the product is made as a tabloid, the "column perforation" is created by the use of the transverse perforation device. The perforation which is horizontal in the reading direction in the end product, however, is produced by the use of a longitudinal perforation device. If the product is not only to be perforated continuously horizontally, but also perforated partially, for example in columns, the perforating circumference of the longitudinal perforation cutter is divided in accordance with the column width, similar to a skip-slitter cutter.

In order to be able to react as flexibly as possible to different column widths and to columns, which are to be perforated, or respectively not perforated, within the same perforation track, it is necessary that the longitudinal perforation cutter holder can be universally employed. To this end, it is necessary that it can be displaced transversely to the web running direction as desired, and can receive different perforation cutters of different circumferential design or, even better, different individual cutter circumference segments at any arbitrary location. Because of this, it is possible to create perforation lines of any desired width, which can be interrupted at any desired intervals, at any desired location of the page.

While preferred embodiments of a method for producing a printed product in accordance with the present invention have been set forth fully and completely hereinabove, it will be apparent to one of skill in the art that various changes in, for example the specific type of printing devices used, the particular folders used and the like may be made without departing from the true spirit and scope of the present invention, which is accordingly to be limited only by the following claims.

What is claimed is:

1. A method for producing a printed product on a web-fed rotary printing press including:

printing a plurality of materials having material web outer edges and material web widths;

printing a plurality of partial material webs having partial material web outer edges and partial material web widths;

longitudinally folding at least a first of said plurality of material webs and producing a first material web longitudinal fold line;

longitudinally folding at least a first of said partial material webs and producing a first partial material web longitudinal fold line;

using said first partial material web longitudinal fold line for dividing said first partial material web at a partial web width ratio of ¼ to ¾ combining said material webs and said partial material webs and making said longitudinal fold lines congruent;

positioning at least one of said partial web outer edges neither congruent with said material outer edges of one of said plurality of material webs nor with said longitudinal fold line of said at least a first of said material webs; and selecting a material web width of one of said plurality of said material webs lying on an outside of said printed product being greater than said partial web width.

2. The method of claim 1 including providing said partial web width unequal to half of said material web width.

3. The method of claim 1 further including providing said printed product in a broadsheet format.

4. The method of claim 1 further including fastening a second one of said plurality of partial material webs to said first one of said material webs.

5. The method of claim 1 further including providing said material web width greater than said partial material web width.

6. The method of claim 1 further including providing a width of a second one of said partial material webs being no greater than three-fourths of said width of said first material web.

7. The method of claim 1 further including providing said printed product as a newspaper.

8. The method of claim 1 further including cutting selectively at least one of longitudinal and transverse perforations in at least one of said plurality of material webs and said plurality of partial material webs.

9. A method of producing a printed product on a web-fed rotary printing press including:

printing a plurality of material webs having outer edges and material web widths;

printing a plurality of partial material webs having partial web outer edges and partial web widths;

combining a plurality of said printed material webs and a plurality of said printed partial material webs and forming said printed product with one of said plurality of material webs lying on an outside of said printed product;

positioning said outer edge of a second one of said partial material webs between said outer edges of a first one of said plurality of material webs during said forming of said printed product;

transversely cutting said printed product and positioning a signature cut off from said second partial material web is lying inside a signature cut off said first material web and with a width of said one of said plurality of material webs, lying outside on said printed product, being is greater than a width of said second partial material web; and transversely folding said printed product including said at least one of said plurality of material webs and said plurality of partial material webs.

10. The method of claim 9 further including providing said printed product in a tabloid format.

11. The method of claim 9 further including providing said partial material web widths being equal to one half of said material web widths.

12. The method of claim 9 further including providing said material web width greater than said partial material web width.

13. The method of claim 9 further including providing a width of a second one of said partial material webs being no greater than three-fourths of said width of said first material web.

14. The method of claim 9 further including providing said printed product as a newspaper.

15. The method of claim 9 further including cutting selectively at least one of longitudinal and transverse perforations in at least one of said plurality of material webs and said plurality of partial material webs.

* * * * *

UNITED STATES PATENT AND TRADEMARK OFFICE

CERTIFICATE OF CORRECTION

PATENT NO. : 6,896,250 B2
DATED : May 24, 2005
INVENTOR(S) : Bernd Anton Hillebrand It is certified that error appears in the above-identified patent and that said Letters Patent is hereby corrected as shown below:

Column 5, line 55 - Column 6, line 14,
Claim 1 is replaced with the following:

1. A method for producing a printed product including:

printing a plurality of materials each having material web outer edges and a material web width;

printing a plurality of partial material webs each having partial material web outer edges and a partial material web width;

longitudinally folding at least a first of said plurality of material webs and producing a first material web longitudinal fold line;

longitudinally folding at least a first of said partial material webs and producing a first partial material web longitudinal fold line;

using said first partial material web longitudinal fold line for dividing said first partial material web at a partial web width ratio of 1/4 to 3/4;

combining said at least first material web and said at least first partial material web and making said longitudinal fold lines congruent;

positioning at least one of said longitudinally folded partial web outer edges neither congruent with said material outer edges of said at least first one of said plurality of longitudinal folded material webs nor with said longitudinal fold line of said at least a first one of said material webs;

selecting a material web width of said longitudinally folded at least one of said plurality of said material webs lying on an outside of said printed product being greater than said partial web width; and cutting said combined at least one of said first material webs and said at least first partial material web in a direction transverse to said material and said partial material outer edges for forming said printed product with lengths of said cut material web and of said cut partial material web being equal.

UNITED STATES PATENT AND TRADEMARK OFFICE

CERTIFICATE OF CORRECTION

PATENT NO. : 6,896,250 B2
DATED : May 24, 2005
INVENTOR(S) : Bernd Anton Hillebrand It is certified that error appears in the above-identified patent and that said Letters Patent is hereby corrected as shown below:

Column 6,
Lines 32-55, claim 9 is replaced with the following:

9. A method of producing a printed product including:

printing a plurality of material webs each having material web outer edges and a material web width;

printing a plurality of partial material webs each having partial material web outer edges and a partial material web width;

combining a plurality of said printed material webs and a plurality of said printed partial material webs and forming said printed product with one of said plurality of material webs lying on an outside of said printed product;

positioning at least one of said outer edges of at least one of said partial material webs between said outer edges of a first one of said plurality of material webs during said forming of said printed product;

transversely cutting said printed product and positioning a signature cut off from said partial material web lying inside a signature cut off said first material web and with a width of said one of said plurality of material webs, lying outside, on said printed product, being greater than a width of said partial material web and forming said printed product with lengths of said material webs and of said partial material webs being equal; and transversely folding said printed product including said at least one of said plurality of material webs and said plurality of partial material webs.

Signed and Sealed this

Nineteenth Day of July, 2005

JON W. DUDAS
*Director of the United States Patent and Trademark Office*